US005611117A

United States Patent [19]

Friedrich et al.

[11] Patent Number: 5,611,117

[45] Date of Patent: Mar. 18, 1997

[54] SPINNING PLANT MACHINE WITH ATTACHMENT FOR CAN TRANSPORTING CARRIAGE

[75] Inventors: Hauner Friedrich; Wagner Manfred, both of Ingolstadt, Germany

[73] Assignee: Rieter Ingolstadt, Spinnereimaschinenbau AG, Ingolstadt, Germany

[21] Appl. No.: 319,869

[22] Filed: Oct. 7, 1994

[30] Foreign Application Priority Data

Oct. 29, 1993 [DE] Germany ..... 43 37 115.9

[51] Int. Cl.[6] ..... D01G 21/00; B65G 3/00

[52] U.S. Cl. ..... 19/159 A; 414/401

[58] Field of Search ..... 19/157, 159 R, 19/159 A; 414/401, 504; 340/687; 280/508

[56] References Cited

U.S. PATENT DOCUMENTS 4,127,856 11/1978 Bickel et al. ..... 141/401
4,993,121 2/1991 Sartoni et al. ..... 19/159 A
5,276,947 1/1994 Fritschi et al. ..... 19/159 A
5,391,045 2/1995 Raasch et al. ..... 19/159 A

*Primary Examiner*—C. D. Crowder
*Assistant Examiner*—Larry D. Worrell, Jr.
*Attorney, Agent, or Firm*—Dority & Manning

[57] ABSTRACT

Disclosed is a spinning mill machine for the production of fiber sliver and for the deposit of the fiber sliver in spinning cans, with an automatic can replacement device to push out full cans from the machine. A can conveying carriage is centered at the spinning mill machine by means of a centering unit. The can conveying carriage is locked at the machine in order to hold the carriage in a receiving-ready position. A signal transmitter is provided to inform the machine by signal when the can conveying carriage is full. According to the invention the centering unit, the locking unit and the signal transmitter are installed in one single assembly in immediate proximity of the spinning machine.

7 Claims, 2 Drawing Sheets

SPINNING PLANT MACHINE WITH ATTACHMENT FOR CAN TRANSPORTING CARRIAGE

BACKGROUND OF THE INVENTION

Can conveying carriages which convey spinning cans, receive several full spinning cans at fiber-sliver producing machines, e.g. draw frames, and convey them to a fiber sliver processing machine are known in spinning operations. The conveying carriages are designed so that they can be positioned at the can discharge location of the fiber sliver producing machine and are able to receive pushed-out cans. The reception is effected in that the can pushed out by the machine is pushed on the conveying carriage and pushes the cans already in place thereon farther by one position. Near the end of the conveying carriage, a signal transmitter is installed on the floor of the spinning shop to signal the machine when a can comes within its range. The signal causes the machine to interrupt the filling of additional spinning cans with fiber sliver since no more capacity is left on the conveying carriage. It is a disadvantage in this device that the signal transmitter is mounted on a rod next to the machine. This rod causes injuries to operators or may be damaged by fork lifts, for example, which circulate in the spinning mill.

OBJECTS AND SUMMARY OF THE INVENTION

It is a principal object of the instant invention to provide a device to signal the fiber sliver producing machine safely when the conveying carriage receiving the spinning can is full and to furthermore considerably increase the safety of the operating personnel and of the device against damage. Additional objects and advantages of the invention will be set forth in part in the following description, or will be obvious from the description, or may be learned through practice of the invention.

The objects are attained through the advantageous embodiments of the present invention. The state of the art and an embodiment of the instant invention are shown in the following figures.

DETAILED DESCRIPTION OF THE PREFERRED EMBODIMENTS

Figure 1:
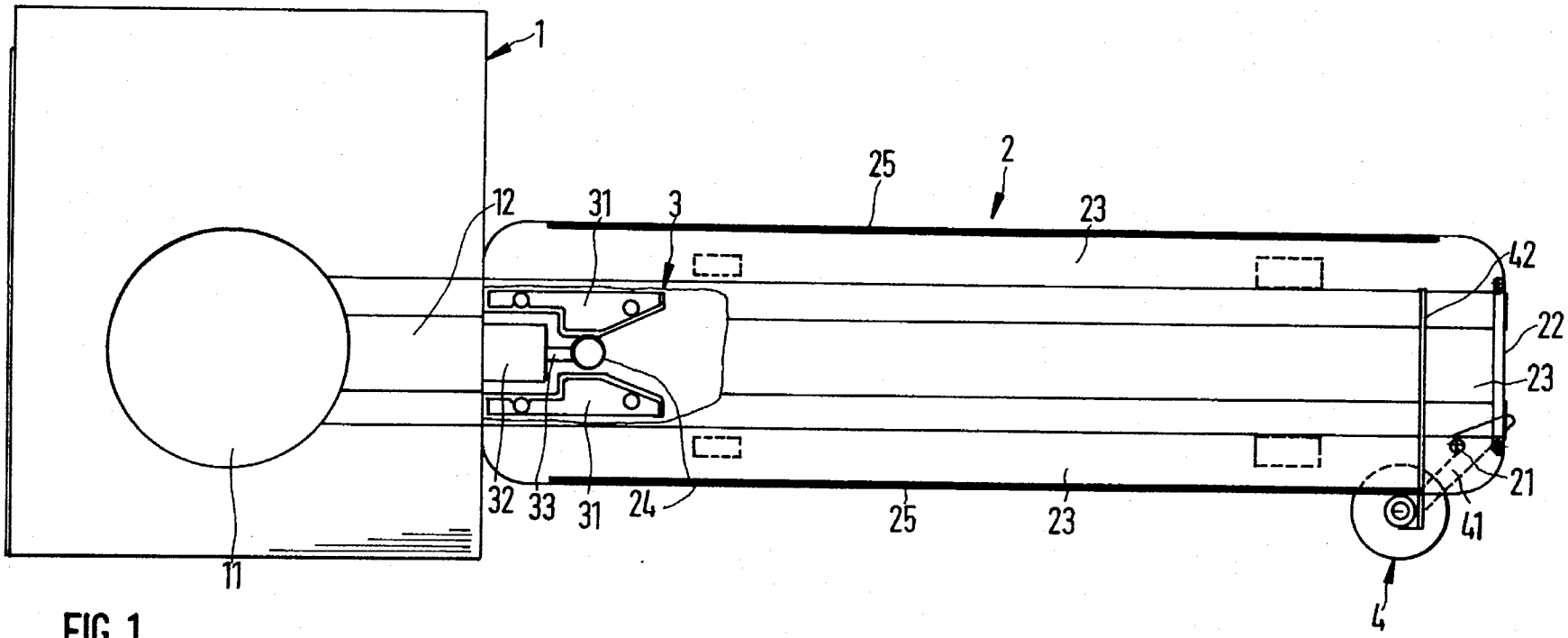
FIG. 1 shows a state of the art can conveying carriage at a fiber sliver producing machine.

Reference will now be made in detail to the presently preferred embodiments of the invention, one or more examples of which are shown in the accompanying drawings. Each example is provided by way of explanation of the invention, and not as a limitation of the invention. In fact, it will be apparent to those skilled in the art that various modifications and variations can be made in the invention without departing from the scope of the invention. Additionally, the numbering of components in the drawings is consistent, with the same components having the same number throughout.

FIG. 1 shows a device according to the state of the art. A fiber sliver is deposited in a can 11 at a spinning mill machine 1. When the can 11 is full, it is pushed out of the spinning mill machine 1 on a conveying carriage 2 over a rail 12. The conveying carriage 2 is designed either as an automotive vehicle or as a hand cart as shown in FIG. 1, and is equipped in that case with a handle 22 for an operator. Supporting rails 23 on which the cans 11 glide are installed on the conveying carriage 2. The can 11 is guided laterally by means of a guide 25.

In order to position the conveying carriage 2 at the spinning mill machine, a method is known by which the conveying carriage 2 is held between a centering unit 3 and a locking unit 4. The top of the conveying carriage 2 is in part broken through in this illustration, so that the centering unit 3 is visible. The centering unit 3 consists of two centering elements 31 which are fixedly attached on the shop floor. Seen in the direction of arrival of the conveying carriage 2, a switch 32 is installed at the end of the centering unit 3. The switch 32 is provided with a pin by means of which a signal is transmitted to the spinning mill machine 1 indicating whether a conveying carriage 2 is available to receive cans 11. If this is not the case, the fiber sliver deposit in additional cans 11 is stopped at the spinning mill machine 1. As the conveying carriage 2 is pushed into the centering unit 3 by means of a pipe 24, the switch 32 is actuated by the pipe 24 on the carriage 2 and the pin 33. As soon as the conveying carriage is centered and positioned, a locking lever 41 of the locking unit 4 engages a lock 21 of the conveying carriage 2. The locking lever 41 is mechanically connected to a swivelling hoop 42 which is installed in the area of the expected spinning cans. The locking unit 4 must therefore be at a sufficient level so that the locking lever 41 on the one hand reaches below the conveying carriage 2 and the swivelling hoop 42 on the other hand is able to sense above the conveying carriage 2 for the presence of spinning cans 11. This locking unit 4 represents a risk of accident because of its necessary structural height.

Figure 2:
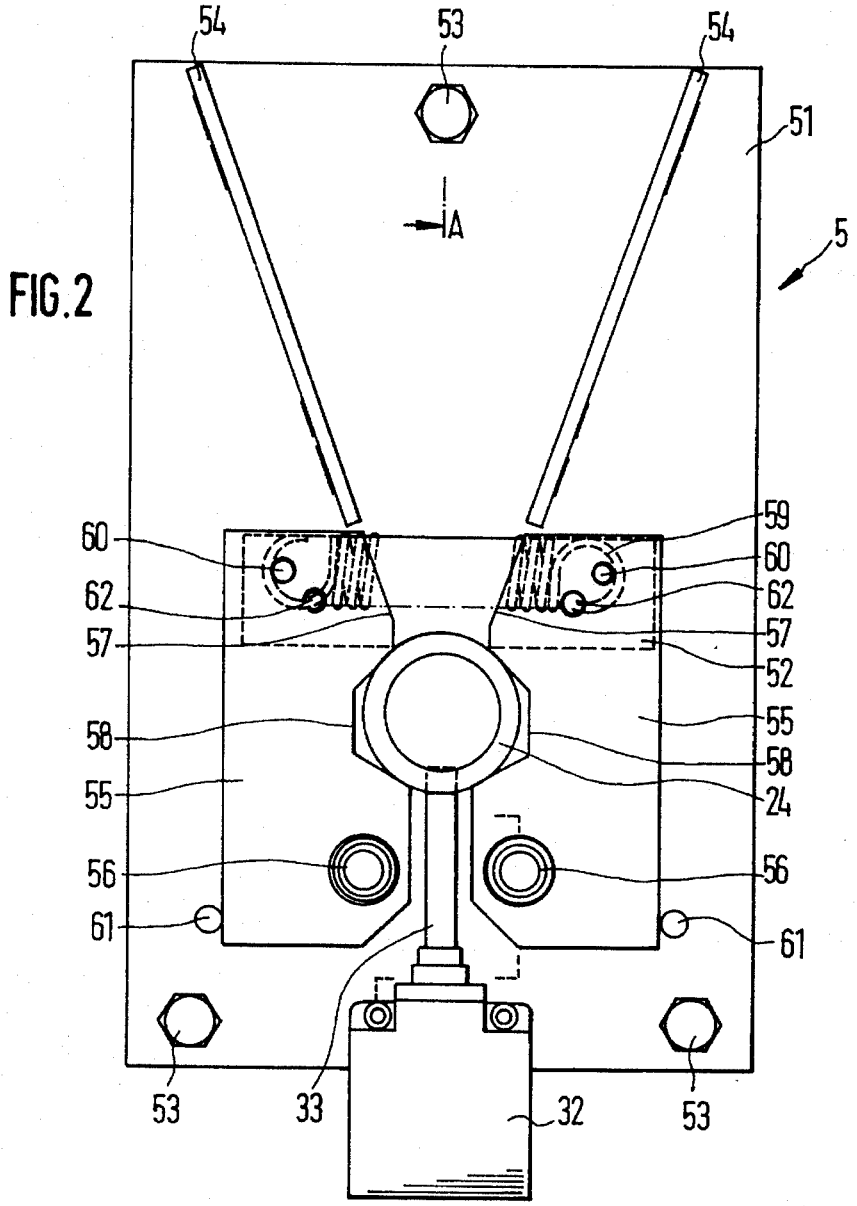
FIG. 2 shows a can carriage locking device in a top view.

FIG. 2 shows the structural unit according to the invention which contains a centering and locking unit as well as a signal transmitter for the conveying carriage 2. The centering and locking device 5 is built on a floor plate 51 in the same manner as the signal transmitter. This floor plate 51 must be attached before the spinning mill machine 1 by means of screws 53. The attachment must be such that the can 11 pushed out of the spinning mill machine 1 can be accepted by the conveying carriage 2. The rails 12 must match the supporting rails 23 of the conveying carriage 2 in this case.

The bottom plate 51 is provided with a recess 52 to receive a spring 59 the action of which shall be explained further below. Two centering plates 54 are attached to the bottom plate 51 and are facing each other conically. The shortest distance to the centering plates 54 is near the locking elements 55. If the locking elements 55 have longer sides, the centering plates may also be omitted in another embodiment. The locking elements 55 are installed rotatably on the bottom plate 51 by means of rotation axes 56. The locking elements 55 are provided with an insertion bevel 57 which is aligned with the corresponding centering plate 54. This ensures easy introduction of the pipe 24 into the locking elements 55. The insertion bevel 57 is followed by a locking notch 58. The pipe 24 is held in this locking notch 58 by the centering and locking unit.

The locking elements 55 are pressed against a stop 61 by means of a spring 59. The spring 59 is attached by means of a bolt 60 to the locking element 55. The bolt 60 is either in the position shown in FIG. 2 connected to the locking element 55 or, in order to achieve a modified holding force, is placed in a bore 62 in the locking element 55. Through this modified position, i.e. a modified lever arm in relation to the rotation axis 56 and/or by means a spring with different spring characteristics, the locking force of the locking elements 55 can be adjusted.

A stop 61 is provided to ensure that the insertion bevels 57 are always aligned with the centering plates 54. The two locking elements 55 can be moved only so far towards each other by mens of this stop 61 and via spring 59 that they come into alignment with the centering plates 54.

The switch 32 is furthermore installed on the bottom plate 51. Pin 33 serves as an actuating element and extends into the space between the locking notches 58. As soon as a pipe 24 is present in the space between the locking notches 58, the pin 33 is pressed into the switch 32 and triggers a signal to the spinning mill machine 1, whereby the surrender of the can by the spinning mill machine 1 is made possible. As soon as the pin 33 is in its rest position due to the absence of a pipe 24, the spinning mill machine 1 is informed by signal that the can transfer must be stopped.

The pipe 24 is held in its position in the space between the locking notches 58 which are pressed together with more or less force by the spring 59. This position is maintained for as long as the cans are being pushed on the conveying carriage 2. As soon as the conveying carriage 2 can no longer receive more cans, the last arrived but no longer accepted can 11 pushes the conveying carriage 2 out of the centering and locking unit. Through this the spinning mill machine 1 is informed by signal that no more cans may be received and the production of additional cans is stopped. Depending on need, i.e. depending on the size and weight of the cans 11, a spring 59 with more or less force or a lever arm that is more or less large are selected between the bolt 60 and the rotation axis 56. In each case it must be ensured that the pipe 24 is not moved out of the centering and locking unit 5 during a normal filling process of conveying carriage 2. Only when the carriage 2 is completely full, i.e. when the first can has reached the end of the conveying carriage 2 and is to push the conveying carriage 2 out of the centering and locking device 5 by means of the thrusting force of the lined-up cans and the excess can which has been pushed out, is the pipe 24 allowed to come out of the locking notch 58 and to release the signal via switch 32.

In the instant invention it is especially advantageous that the centering and locking unit 5 is very small and makes the separate locking unit 4 unnecessary. As already described earlier, the separate locking unit 4 has the disadvantage that it was structurally especially high and had to be installed in the shop floor at a relative great distance from the spinning mill machine 1. This increased the risk of accident. Thanks to the centering and locking device 5 of the invention the entire assembly is located in immediate proximity of the spinning mill machine 1 and the risk of accident is thereby lowered considerably.

Figure 3:
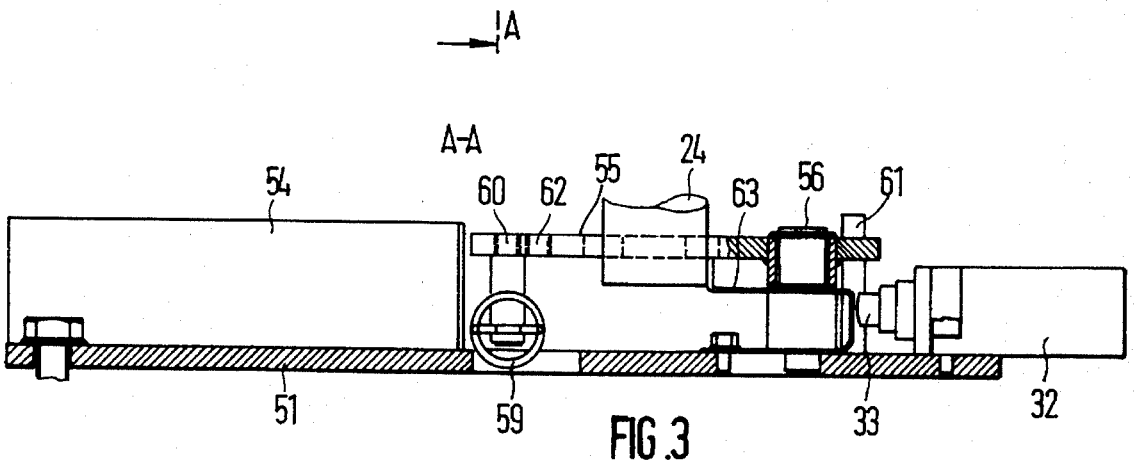
FIG. 3 shows a can carriage locking device according to FIG. 2, in a cut-away section.

FIG. 3 shows the essential features of the centering and locking unit 5 of FIG. 2, in a cutaway section A—A. The only difference between the two drawings is that in FIG. 3 a pin 33 does not actuate the switch 32 directly via pipe 24 as in FIG. 2, but that a leaf spring 63 is installed between the pin 33 and the pipe 24. This leaf spring 63 attenuates the actuation of switch 32 by pipe 24. In this manner, the switch 32 is protected against damage since shocks that may be caused by the pipe 24 cannot be transmitted directly to the switch 32 but are attenuated by the leaf spring 63.

As is shown in the drawing of FIG. 3, the spring 59 is set very low so as to let the pipe 24 slide over it. The spring 59 is therefore embedded in part in the bottom plate 51.

The instant invention is not limited to the shown embodiment. Thus for example, the switch 32 in particular may also be made in form of a proximity switch.

It will be apparent to those skilled in the art that various modifications and variations can be made in the present invention without departing from the scope or spirit of the invention. For example, features illustrated or described as part of one embodiment may be used on another embodiment to yield a still further embodiment. It is intended that the present invention cover such modifications and variations as come within the scope of the appended claims and their equivalents.

I claim:

1. A spinning mill machine for the production and transfer of fiber silver into spinning cans, said machine comprising:

an automatic can replacement device configured to push full cans out of said machine into a can conveying carriage;

a centering device configured to center a can conveying carriage at said machine at a receiving location wherein said automatic can replacement device is able to convey full cans to the can conveying carriage;

a signal transmitter operably disposed at said receiving location to sense the presence of a can conveying carriage at said receiving position;

an automatically releasable locking device configured to hold the can conveying carriage at said receiving position; and wherein said centering device, said signal transmitter, and said locking device are configured as a single assembly disposed directly adjacent said automatic can replacement device of said machine, and wherein said locking device automatically releases said conveying carriage upon said carriage being filled with spinning cans.

2. The machine as in claim 1, further comprising a single plate, said assembly built onto said plate, said plate configured for mounting on a floor of a spinning mill adjacent said automatic can replacement device.

3. The machine as in claim 1, wherein said centering device comprises oppositely facing plates angled so as to define a tapered opening into said locking device.

4. The machine as in claim 3, wherein said locking device comprises two oppositely facing spring loaded locking elements, said locking elements defining a recess for a locking pipe disposed on a can conveying carriage.

5. The machine as in claim 4, wherein said locking device comprises a spring having an adjustable tension means.

6. The machine as in claim 1, wherein said signal transmitter comprises a switch and a pin operably contacting said switch when a can conveying carriage is locked in said locking device.

7. The machine as in claim 6, further comprising a leaf spring operably disposed to contact said pin and actuate said switch.

* * * * *